US010888131B2

(12) United States Patent
Moores

(10) Patent No.: US 10,888,131 B2
(45) Date of Patent: Jan. 12, 2021

(54) ADHESIVE SOFT FABRIC CORNERS TO INCREASE GARMENT COMFORT

(71) Applicant: Susan Block Moores, Bethesda, MD (US)

(72) Inventor: Susan Block Moores, Bethesda, MD (US)

( * ) Notice: Subject to any disclaimer, the term of this patent is extended or adjusted under 35 U.S.C. 154(b) by 128 days.

(21) Appl. No.: 16/222,595

(22) Filed: Dec. 17, 2018

(65) Prior Publication Data

US 2020/0187577 A1 Jun. 18, 2020

(51) Int. Cl.

| | |
|---|---|
| ***A41D 27/08*** | (2006.01) |
| *A41C 3/12* | (2006.01) |
| *A41B 1/08* | (2006.01) |
| *A41D 27/13* | (2006.01) |
| *A41D 27/14* | (2006.01) |
| *A41D 27/04* | (2006.01) |
| *A41D 27/16* | (2006.01) |
| *A41B 1/12* | (2006.01) |

(52) U.S. Cl.

CPC ..... *A41D 27/08* (2013.01); *A41B 1/08* (2013.01); *A41B 1/12* (2013.01); *A41C 3/12* (2013.01); *A41C 3/126* (2013.01); *A41D 27/04* (2013.01); *A41D 27/085* (2013.01); *A41D 27/13* (2013.01); *A41D 27/133* (2013.01); *A41D 27/136* (2013.01); *A41D 27/14* (2013.01); *A41D 27/145* (2013.01); *A41D 27/16* (2013.01); *A41D 2300/328* (2013.01)

(58) Field of Classification Search

CPC ..... A41D 27/08; A41D 27/085; A41D 27/04; A41D 27/13; A41D 27/133; A41D 27/136; A41D 27/14; A41D 27/145; A41D 27/16; A41D 2300/328; A41B 1/08; A41B 1/12; A41C 3/12; A41C 3/126

USPC ..... 2/244

See application file for complete search history.

(56) References Cited

U.S. PATENT DOCUMENTS

| | | | | | |
|---|---|---|---|---|---|
| 155,529 | A | * | 9/1874 | Lockwood | A41D 27/13 2/53 |
| 371,705 | A | * | 10/1887 | Rauh | A41D 27/13 2/58 |
| 460,825 | A | * | 10/1891 | Eleinert | A41D 27/13 2/53 |
| 487,164 | A | * | 11/1892 | Stanley | A41D 27/13 2/53 |
| 1,095,721 | A | * | 5/1914 | Flade | A41D 27/13 2/53 |

(Continued)

*Primary Examiner* — Khaled Annis
*Assistant Examiner* — Dakota Marin
(74) *Attorney, Agent, or Firm* — Dunlap Bennett & Ludwig, PLLC; Brendan E. Squire

(57) ABSTRACT

An adhesive soft fabric corner to increase garment comfort. The soft corners are folded fabric elements with an adhesive layer applied to secure to a garment. The soft corners covers irritating garment corners, increasing apparel comfort and lifespan. Soft Corners will introduce soft fabric that you want to have near your skin. Soft Corners will proactively protect the skin without sticking to the skin. Soft Corners can be produced in an endless variety of colors and shapes and sizes which can provide comfort in any style of clothing. Soft Corners will increase the lifespan of our clothing, reducing the waste of time, money and materials associated with clothing manufacturing and most importantly the consumer.

10 Claims, 4 Drawing Sheets

(56) References Cited

U.S. PATENT DOCUMENTS 1,764,555 A * 6/1930 Friedlander ..... A41D 27/13 2/56
2,058,052 A * 10/1936 Bendersky ..... A41D 27/13 2/53
2,344,781 A * 3/1944 Mullen ..... A41D 27/13 2/53
3,154,787 A 11/1964 Jack et al.
4,575,874 A * 3/1986 Johnson ..... A41F 15/007 2/460
4,638,513 A 1/1987 Woods
4,795,399 A 1/1989 Davis
4,795,400 A 1/1989 Greenberg
4,945,576 A * 8/1990 Melton ..... A41F 15/007 2/460
5,201,078 A 4/1993 Melton
5,474,487 A 12/1995 Roush et al.
5,507,681 A 4/1996 Smith et al.
5,800,245 A 9/1998 Barbe-Vicuna et al.
5,803,792 A 9/1998 Roush et al.
5,830,040 A 11/1998 Morgan et al.
5,913,413 A 6/1999 Huyck
6,203,399 B1 3/2001 Hackney
6,681,407 B2 1/2004 Martz
8,047,892 B1 11/2011 Dempsey
2004/0226069 A1 11/2004 Reeves
2005/0097658 A1 5/2005 Lyons et al.
2005/0098258 A1 5/2005 Batcha
2006/0282934 A1 12/2006 Fildan et al.
2007/0150995 A1* 7/2007 Luna ..... A41D 27/13 2/53
2007/0157358 A1* 7/2007 Sharon ..... A41D 13/1236 2/69
2008/0066212 A1* 3/2008 Holden ..... A45C 1/04 2/69
2008/0134552 A1* 6/2008 Lough ..... G09F 21/02 40/586
2008/0319411 A1* 12/2008 Mortensen ..... A61F 13/4702 604/387
2009/0265830 A1* 10/2009 Hendrickson ..... A41D 1/215 2/104
2011/0185470 A1* 8/2011 Jones ..... A41D 1/06 2/69
2011/0252534 A1* 10/2011 Taylor ..... A41D 27/13 2/46
2012/0028539 A1 2/2012 McCarty
2013/0035018 A1 2/2013 Broussard
2013/0062230 A1 3/2013 Mattingly
2017/0013892 A1 1/2017 Horner
2017/0027259 A1 2/2017 Fung

* cited by examiner

ADHESIVE SOFT FABRIC CORNERS TO INCREASE GARMENT COMFORT

BACKGROUND OF THE INVENTION

The present invention relates to garments, and more particularly to items to enhance garment comfort.

Inexpensive articles of clothing are usually poorly crafted. Often, the materials selected or the construction of the garments can present irritants to the wearer. For example, a $40 bra may have a pin sized piece of nylon stitching that digs into the middle of the wearer's back. Likewise, raised stitching to secure a manufacturer's label to a shirt may be irritating the skin or the label itself is irritating to the skin. The process of manufacturing cheap goods, buying them and throwing them out or wearing them and being uncomfortable wastes money, time and materials. There is no product that keeps such clothing irregularities from irritating the skin.

As can be seen, there is a need for an apparatus and method for alleviating skin irritation caused by tags, stitching, or seams in a garment.

SUMMARY OF THE INVENTION

In one aspect of the present invention a protective tab for a garment is disclosed. The protective tab includes a first strip having a first soft fabric layer. A releasable adhesive is applied to a garment facing surface of the first soft fabric layer. A backing layer is applied to the releasable adhesive. The first strip is folded onto itself along a first fold line. A second strip having a second soft fabric layer and a non-releasing adhesive applied to an inner surface of the second soft fabric layer. The second strip is folded onto the first strip along a second fold line and secured to an outer surface of the first strip via the non-releasing adhesive to define a pocketed opening dimensioned to receive an edge of the garment.

In some embodiments, the first fold is angled relative to the second fold to define the pocketed opening. The second strip may be dimensioned to substantially overlap the first strip. Preferably, the first fold is substantially perpendicular to the second fold. The first strip and the second strip may be rectangular.

Other aspects of the invention include a method of protecting a wearer's skin from an edge of a garment. The method includes providing a protective tab having first strip and a second strip formed of a soft fabric material. The first strip has a releasable adhesive layer on a garment facing surface and a backing layer removably adhered to the releasable adhesive layer. The first strip is folded onto itself along a first fold. The second strip is adhered to an outer surface of the first strip about a second fold that is angled with respect to the first fold to define a pocket dimensioned to receive an edge of a garment.

The method also includes removing the backing layer. Next an edge of the garment is inserted into the pocket. An outer surface of the protective tab is pressed to adhere the releasable adhesive to the edge of the garment. The garment may include one or more corners of a garment tag. The garment may also include a corner hem of the garment.

These and other features, aspects and advantages of the present invention will become better understood with reference to the following drawings, description and claims.

DETAILED DESCRIPTION OF THE INVENTION

Figure 1:
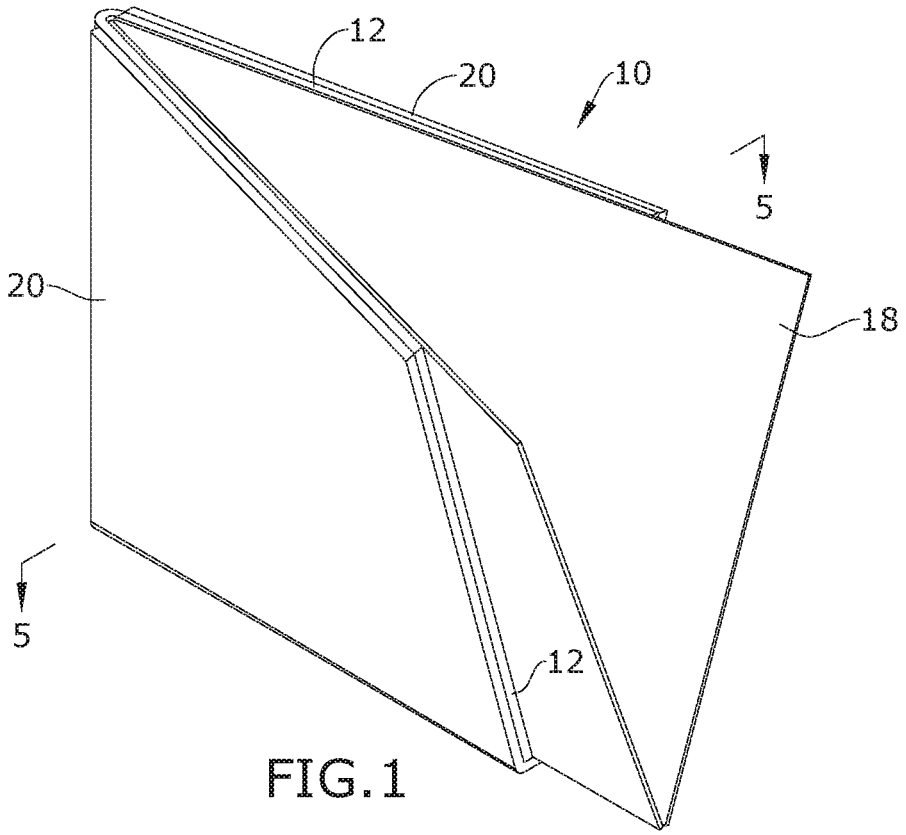
FIG. 1 is a perspective view of the adhesive soft fabric corner, shown in an open position.
Figure 2:
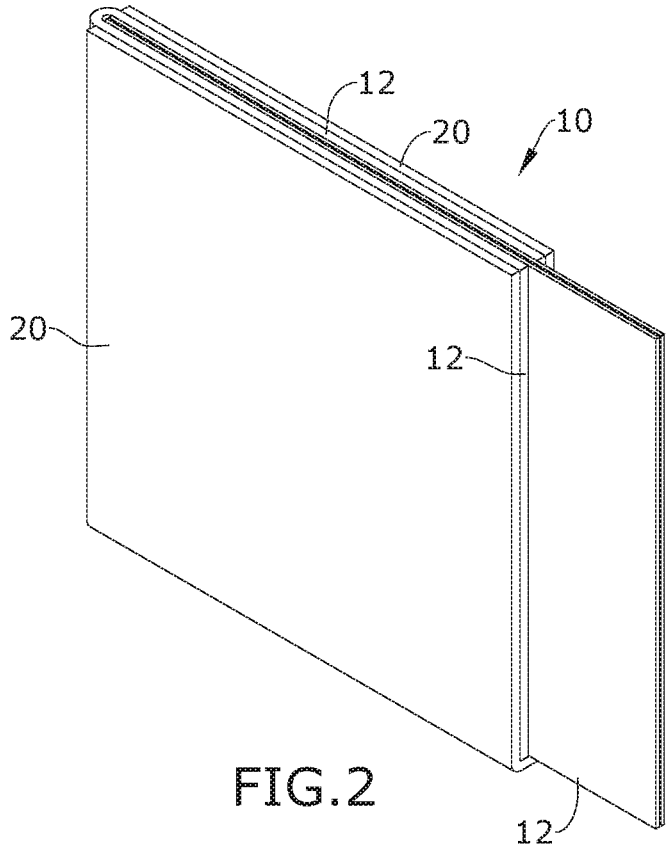
FIG. 2 is a perspective view of the adhesive soft fabric corner, shown in a closed position.
Figure 3:
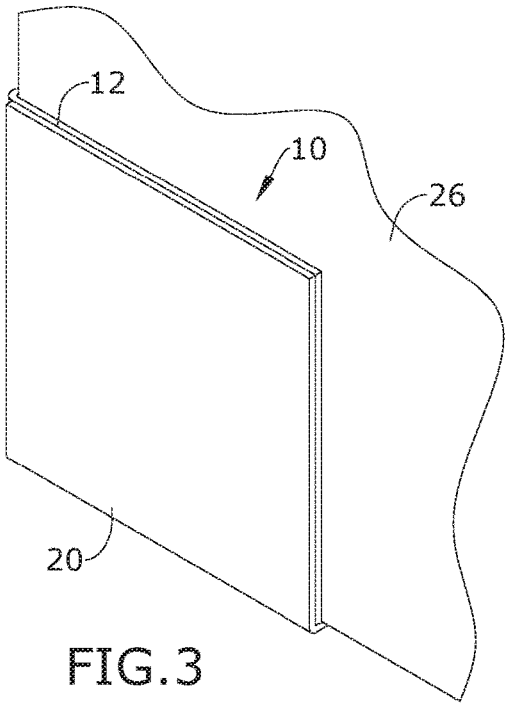
FIG. 3 is a perspective view of the adhesive soft fabric corner, shown applied to a garment.
Figure 4:
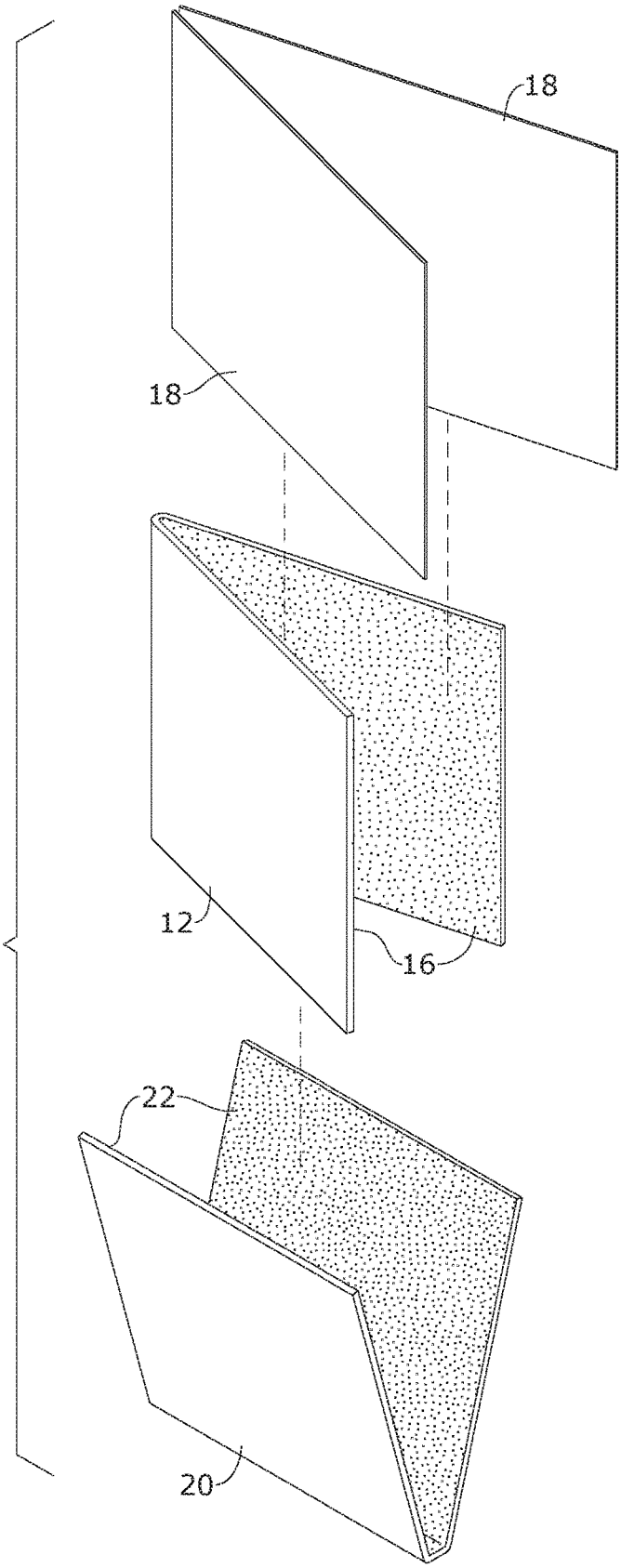
FIG. 4 is an exploded view of the soft fabric corner.
Figure 5:
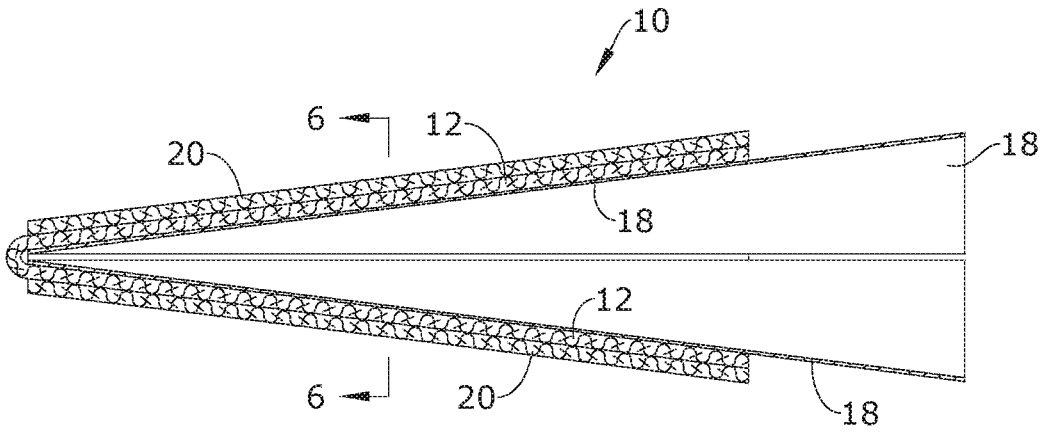
FIG. 5 is a section view of the soft fabric corner, taken along line 5-5 in FIG. 1.
Figure 6:
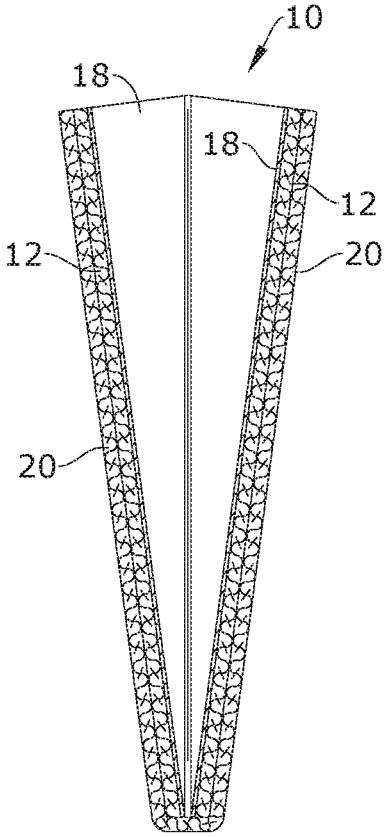
FIG. 6 is a section view of the soft fabric corner, taken along line 6-6 in FIG. 5.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, embodiments of the present invention provide a protective soft fabric tab to increase garment comfort. The tabs may be applied to a skin irritant of a garment item. The skin irritant may be a stiff, scratchy manufacturer's tag, a bulky or inconveniently positioned stitch in the garment, a bunching or seam of a garment that presents an annoyance to the wearer of the garment.

As seen in reference to FIGS. 1-6, a protective soft fabric tab 10 according to an embodiment of the invention includes a plurality of fabric layers 12, 20 that may be adhered to a garment via an adhesive layer 16. The plurality of fabric layers 12, 20 may be formed in any suitable shape. In the non-limiting embodiment shown, the plurality of fabric layers 12, 20 may include an inner fabric layer 12 that has a layer of light, non-permanent, releasable adhesive 16 applied to a garment engaging face of the tab 10.

A removable protective backing 18 is applied to the releasable adhesive layer 16. The protective baking 18 is removed from the soft fabric tab 10 prior to application to a garment. The inner fabric layer 12, releasable adhesive 16, and protective backing 18 may be formed as a first small rectangular strip that is folded onto itself.

An outer fabric layer 20 may also be formed as a second small rectangular strip with a strong, non-releasable adhesive layer 22. The outer fabric layer 20 is formed along a second fold so that the non-releasable adhesive layer 22 adheres to the first fabric strip, such that the inner fabric layer 12 and the outer fabric layer 20 define a pocketed opening that may receive an edge of the garment. Preferably, the first fold and the second fold are perpendicular to one another so that the soft fabric tab defines a right corner. The outer fabric layer 20 is dimensioned so that it substantially overlaps the inner fabric layer 12.

Figure 7:
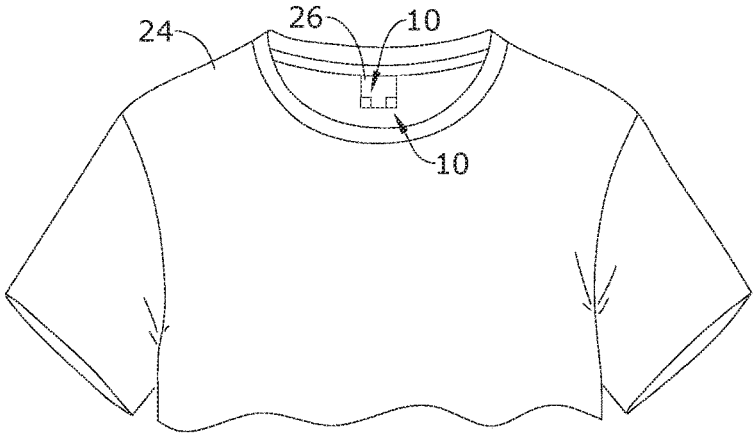
FIG. 7 is a front view of the soft fabric corner, shown applied to an exemplary garment tag.
Figure 8:
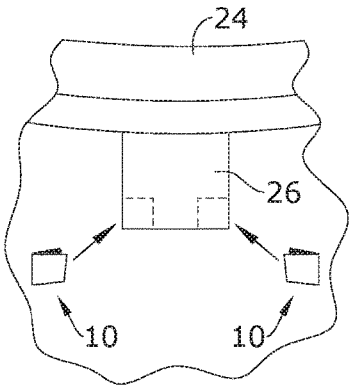
FIG. 8 is a detail front view of the soft fabric corner, illustrating its placement onto an exemplary garment tag.

As seen in reference to FIGS. 7-10, the protective soft fabric tab 10 is depicted in various applications to a garment 24. In FIGS. 7 and 8, the protective soft fabric tab 10 is shown applied to the corners of a garment tag of a shirt 24. The protective soft fabric tabs 10 eliminate the scratchy corners of the tab 26 from irritating the wearer's skin.

Figure 9:
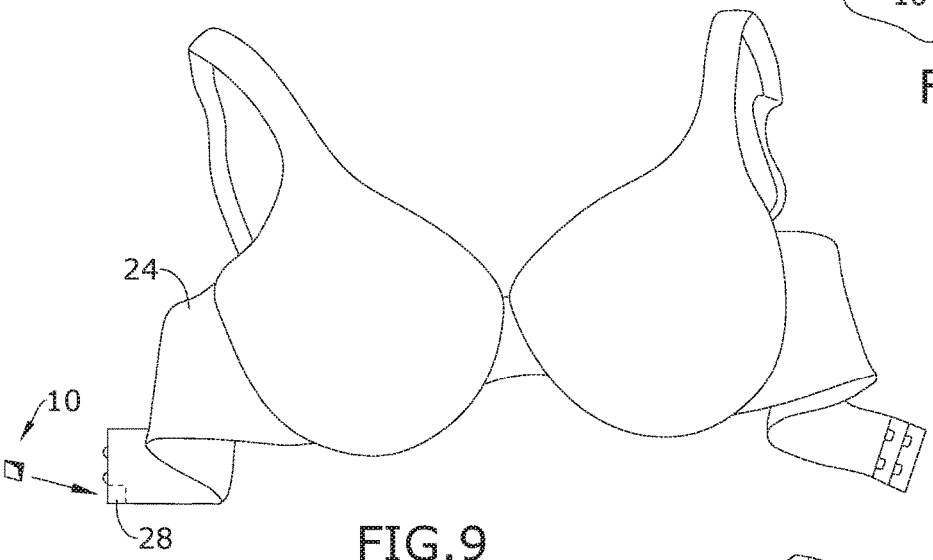
FIG. 9 is a front view of the soft fabric corner, illustrating its placement onto an exemplary garment edge.
Figure 10:
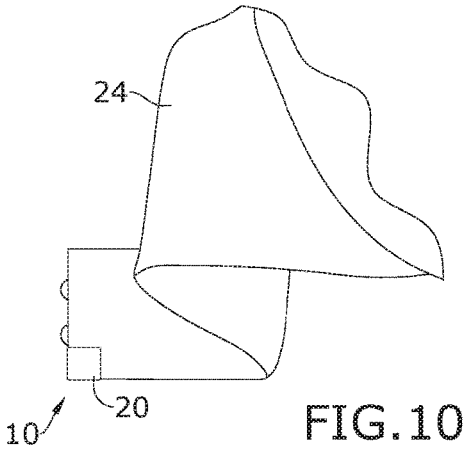
FIG. 10 is a detail front view of the soft fabric corner, shown applied to a garment.

In FIGS. 9 and 10, the protective soft fabric tab 10 is applied to an edge of the garment 20, where the garment 24 edge presents a skin irritant. The protective soft fabric tab 10 may be applied to one or more edges of the garment 24 edge to protect the wearer's skin from irritation.

The Soft Corners of the present invention introduces a soft fabric that the wearer will want to have near their skin. Soft Corners proactively protect the skin without sticking to the skin. Soft Corners can be produced in an endless variety of colors and shapes and sizes which can provide comfort in any style of clothing. Soft Corners will increase the lifespan of our clothing, reducing the waste of time, money and materials associated with clothing manufacturing and most importantly the consumer.

It should be understood, of course, that the foregoing relates to exemplary embodiments of the invention and that modifications may be made without departing from the spirit and scope of the invention as set forth in the following claims.

What is claimed is:

1. A protective tab for a garment, comprising:

a first strip having a first soft fabric layer for avoiding scratching and discomfort to a wearer's skin, a releasable adhesive applied to a garment facing surface of the first soft fabric layer, a backing layer applied to the releasable adhesive, wherein the first strip is folded onto itself along a first fold line such that the garment facing surface on a first side of the first fold line faces the garment facing surface on a second side of the first fold line; and a second strip having a second soft fabric layer, for avoiding scratching and discomfort to a wearer's skin, a non-releasing adhesive applied to an inner surface of the second soft fabric layer, wherein the second strip is folded onto the first strip along a second fold line at an angle offset substantially perpendicular to the first fold line and secured to an outer surface of the first strip via the non-releasing adhesive to define a pocketed opening dimensioned to receive an edge of the garment.

2. The protective tab of claim 1, wherein the first fold is angled relative to the second fold to define the pocketed opening.

3. The protective tab of claim 2, wherein the second strip is dimensioned to substantially overlap the first strip.

4. The protective tab of claim 1, wherein the first strip and the second strip are rectangular.

5. A method of protecting a wearer's skin from an edge of a garment, comprising:

providing a protective tab having a first strip and a second strip formed of a soft fabric material for avoiding scratching and discomfort to a wearer's skin, the first strip having a releasable adhesive layer on a garment facing surface, a backing layer removably adhered to the releasable adhesive layer, the first strip folded onto itself along a first fold such that the garment facing surface on a first side of a fold line faces the garment facing surface on a second side of the first fold line, the second strip is adhered to an outer surface of the first strip about a second fold line that is angled substantially perpendicular with respect to the first fold to define a pocket dimensioned to receive an edge of a garment.

6. The method of claim 5, further comprising:

removing the backing layer.

7. The method of claim 6, further comprising:

inserting an edge of the garment into the pocket.

8. The method of claim 7, further comprising:

pressing an outer surface of the protective tab to adhere the releasable adhesive to the edge of the garment.

9. The method of claim 8, wherein the edge of the garment includes one or more corners of a garment tag.

10. The method of claim 8, wherein the edge of the garment includes a corner hem of the garment.

* * * * *